US009457607B2

(12) United States Patent
Hara

(10) Patent No.: US 9,457,607 B2
(45) Date of Patent: Oct. 4, 2016

(54) IMAGE FORMING METHOD

(71) Applicant: MIMAKI ENGINEERING CO., LTD., Nagano (JP)

(72) Inventor: Hirofumi Hara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/726,616

(22) Filed: Jun. 1, 2015

(65) Prior Publication Data

US 2015/0367655 A1 Dec. 24, 2015

(30) Foreign Application Priority Data

Jun. 23, 2014 (JP) ..... 2014-128619

(51) Int. Cl.

*B41M 5/00* (2006.01)
*B41J 11/00* (2006.01)
*B41M 7/00* (2006.01)

(52) U.S. Cl.

CPC ..... *B41M 5/0017* (2013.01); *B41J 11/0015* (2013.01); *B41M 5/0011* (2013.01); *B41M 7/0036* (2013.01); *B41M 7/0045* (2013.01); *B41M 7/0054* (2013.01)

(58) Field of Classification Search

CPC ..... B41J 2202/02; B41J 2/14; B41J 2/04; B41J 2/211; B41J 2/2114; B41J 11/0015; B41M 5/0017; B41M 5/0011; B41M 7/0036; B41M 7/0045; B41M 7/0054

USPC ..... 347/21

See application file for complete search history.

(56) References Cited

U.S. PATENT DOCUMENTS

2007/0172692 A1* 7/2007 Kamimori ..... B05D 5/066 428/681
2012/0120168 A1* 5/2012 Kachi ..... B41J 11/002 347/102
2012/0327147 A1* 12/2012 Okawa ..... B41J 2/2114 347/9

FOREIGN PATENT DOCUMENTS

CN 102529407 7/2012
CN 102858542 1/2013
WO 2011-099560 8/2011

OTHER PUBLICATIONS

"Office Action of China Counterpart Application" with English translation, issued on Jun. 12, 2016, p. 1-p. 11.

* cited by examiner

*Primary Examiner* — Manish S Shah
*Assistant Examiner* — Yaovi M Ameh
(74) *Attorney, Agent, or Firm* — Jianq Chyun IP Office

(57) ABSTRACT

A image forming method is provided to form a high-quality color image having a wrinkle-like texture. A first primer layer 31 is formed by way of discharging first ink, which is photo-curable ink, onto a medium 40 in such a way as to make a perforated coat, and fully hardening the first ink by light irradiation; and a second primer layer 32 is formed by way of discharging second ink onto the medium 40 on which the first primer layer is already formed; and a color ink layer 33 is formed by way of discharging color ink onto the second primer layer.

8 Claims, 5 Drawing Sheets

IMAGE FORMING METHOD

CROSS REFERENCE TO RELATED APPLICATIONS

This application claims the priority benefit of Japan application serial no. 2014-128619, filed on Jun. 23, 2014. The entirety of the above-mentioned patent application is hereby incorporated by reference herein and made a part of this specification.

TECHNICAL FIELD

The present disclosure relates to an image forming method.

DESCRIPTION OF THE BACKGROUND ART

As an image forming method by using an inkjet printer and the like, a method of printing an image on a medium as a recording medium by carrying out screen printing is known.

For example, Patent Document 1 describes an image forming method that makes it possible to form an image having a wrinkle-like texture by using one type of ink.

[Patent Document 1] International Publication WO2011/099560 pamphlet (disclosed on Aug. 18, 2011).

SUMMARY

Problem to be Solved

Incidentally, a technology of Patent Document 1 alone cannot satisfy all of user's various needs, and therefore a new method is required for forming a high-quality color image having a wrinkle-like texture.

For offering a solution to the above issue, the present disclosure provides a new image forming method that makes it possible to form a high-quality color image having a wrinkle-like texture.

Solutions to the Problem

To bring a solution for the subject described above, an image forming method according to an aspect of the present disclosure includes: a first primer layer forming process to form a first primer layer by way of discharging a first ink, which is a photo-curable ink, onto a recording medium in such a way as to make a perforated coat, and hardening the first ink by light irradiation; a second primer layer forming process to form a second primer layer by way of discharging a second ink onto the recording medium on which the first primer layer is already formed; and a color ink layer forming process to form a color ink layer by way of discharging color ink onto the second primer layer.

According to the configuration described above, the first primer layer is formed on the recording medium in advance, so as to become an uneven foundation for obtaining a wrinkle-like texture, by way of discharging the ultraviolet curable ink onto the recording medium in such a way as to make a perforated coat, and by ultraviolet irradiation. Then, by way of discharging the second ink onto the recording medium on which the first primer layer is already formed; while coarse unevenness of the first primer layer is maintained, fine unevenness on a surface of the first primer layer can be canceled by the second primer layer. Accordingly, it is possible to prevent the fine unevenness on the surface of the first primer layer from blocking a spreading movement of the color ink on the recording medium at the time when the color ink is discharged. Thus, it is possible to form a high-quality color image on the first primer layer and the second primer layer; the high-quality color image being able to represent a color gamut equivalent to a full-color print of a plane image, by use of the color ink layer.

In an image forming method according to an aspect of the present disclosure, it is more preferable to carry out the first primer layer forming process multiple times before the second primer layer forming process.

According to the configuration described above, a height of a convex part in the first primer layer can be adjusted. Accordingly, a wrinkle-like texture can properly be adjusted.

In an image forming method according to an aspect of the present disclosure, it is more preferable that; the second ink is a photo-curable ink; and in the second primer layer forming process, after the second ink is discharged, viscosity of the second ink is increased by light irradiation so that the second ink is preliminarily hardened; and then the second ink preliminarily hardened is fully hardened by further light irradiation.

According to the configuration described above, the second ink is preliminarily hardened by way of increasing its viscosity, so that it is possible to suitably prevent an excessive amount of the second ink from flowing out of the recording medium. Furthermore, by way of fully hardening the second ink that is already preliminarily hardened, conditions of the unevenness formed by the first primer layer and the second primer layer can more suitably be controlled.

In an image forming method according to an aspect of the present disclosure, it is more preferable that the second ink is a transparent ink.

According to the configuration described above, by way of irradiating the transparent ink that does not contain any pigment and the like, with ultraviolet light in the second primer layer forming process, viscosity of the transparent ink can more suitably be increased. Thus, unevenness of the second primer layer can more suitably be controlled. Therefore, it is possible to further suitably form a second primer layer that can prevent a color representation range of the color ink layer, from getting degraded.

In an image forming method according to an embodiment of the present disclosure, it is more preferable that the color ink is a photo-curable ink, and the discharged color ink is irradiated with light in the color ink layer forming process.

According to the configuration described above, a color image can be formed, being provided with a wrinkle-like texture and having wide color space.

Advantageous Effect of the Disclosure

According to the present disclosure, an effect is produced in order to make it possible to form a high-quality color image having a wrinkle-like texture.

DESCRIPTION OF THE EMBODIMENTS (Image Forming Method)

An image forming method according to an embodiment of the present disclosure is explained below in more detail, with reference to FIG. 1 through FIG. 3.

Figure 1:
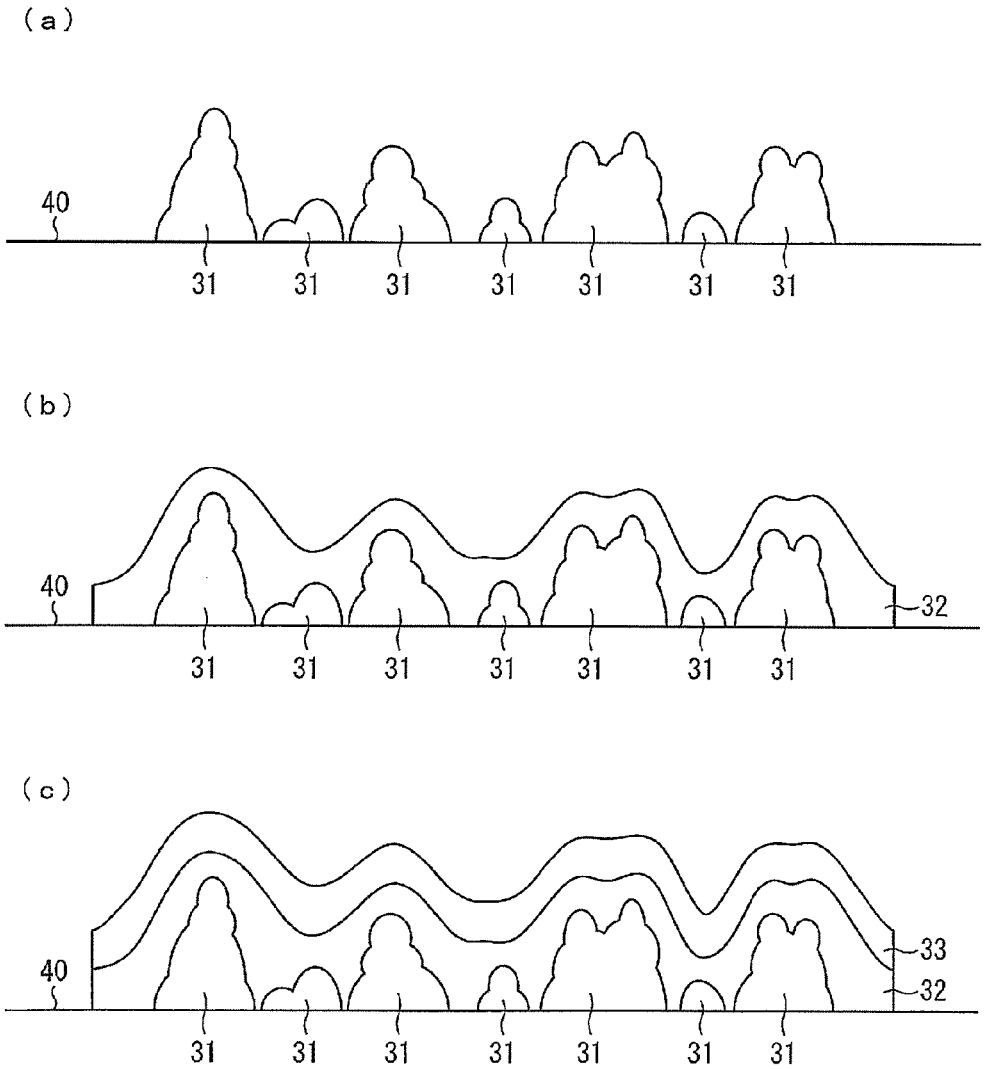
FIG. 1 is a drawing for explaining an outline of an image forming method according to an embodiment of the present disclosure.

The image forming method according to the embodiment of the present disclosure includes a first primer layer forming process to form a first primer layer 31 by way of discharging a first ink, which is a photo-curable ink, onto a medium (a recording medium) 40 in such a way as to make a perforated coat, and hardening the first ink (as (a) shows in FIG. 1).

Thus, the first primer layer 31 can be formed on the medium 40 in advance, so as to become an uneven foundation for obtaining a wrinkle-like texture.

Moreover, the image forming method according to the present embodiment includes a second primer layer forming process to form a second primer layer 32 by way of discharging a second ink onto the medium 40 on which the first primer layer 31 is already formed (as (b) shows in FIG. 1).

Thus, while coarse unevenness of the first primer layer 31 is maintained, fine unevenness on a surface of the first primer layer 31 can be canceled by the second primer layer 32.

Moreover, the second ink is a photo-curable ink. In the second primer layer forming process described above, after the second ink is discharged, viscosity of the second ink is increased by light irradiation so that the second ink is preliminarily hardened; and then the second ink preliminarily hardened is fully hardened by further light irradiation. Incidentally, "preliminarily hardening photo-curable ink" means polymerizing the photo-curable ink by light irradiation, so as to increase the viscosity of the ink to an extent that fluidity of the ink is still maintained.

By way of increasing the viscosity of the second ink, the fluidity of the second ink can be controlled. According to this process, conditions of the unevenness formed by the first primer layer 31 and the second primer layer 32 can more suitably controlled.

Moreover, the image forming method according to the present embodiment includes a color ink layer forming process to form a color ink layer 33 by way of discharging a color ink onto the second primer layer 32 (as (c) shows in FIG. 1).

In the image forming method according to the present embodiment, the fine unevenness on the surface of the first primer layer 31 can be canceled by the second primer layer 32. Accordingly, it is possible to prevent the fine unevenness on the surface of the first primer layer 31 from blocking a spreading movement of the color ink on the medium 40 at the time when the color ink is discharged. Thus, it is possible to form a high-quality color image that can represent a color gamut equivalent to a full-color print of a plane image, by use of a color ink layer.

(Photo-Curable Ink)

Photo-curable ink to be used in the image forming method according to the present disclosure includes visible light curable ink, ultraviolet curable ink, and the like. Being not limited, ink to be used for forming an image in the image forming method according to the present embodiment is, for example, ultraviolet curable ink. Incidentally, the ultraviolet curable ink is an ink that is hardened by ultraviolet irradiation, and the ink contains a resin of monomer, or oligomer and the like, which is polymerized by ultraviolet irradiation, as a binder. Listed as such a resin are epoxy acrylate, urethane acrylate, polyester acrylate, and the like. Moreover, such ultraviolet curable ink may contain a photo-polymerization initiator, a sensitizer, etc., pigment, dye, and the like. Furthermore, it may also contain other elements, for example, such as a leveling agent, a fungicide and so on.

(Inkjet Printing System)

Figure 2:
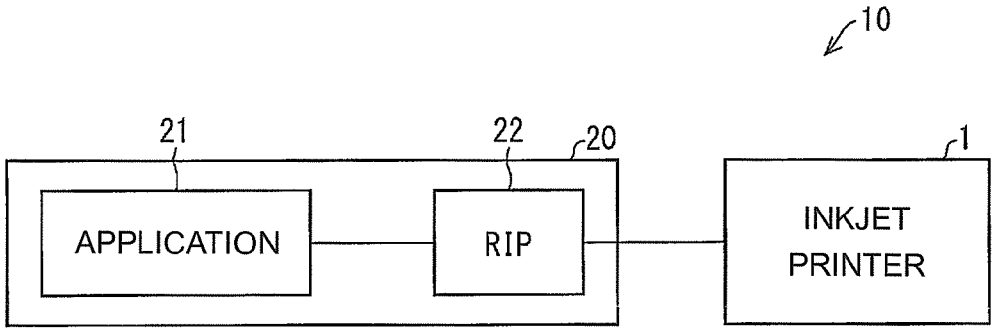
FIG. 2 is a drawing for explaining an outline of a configuration of an inkjet printing system including an inkjet printer to be used for the image forming method according to the embodiment of the present disclosure.

The image forming method according to the present embodiment is implemented in an inkjet printing system including an inkjet printer 1 shown in FIG. 2.

The inkjet printing system includes the inkjet printer 1 for carrying out an inkjet printing, and an external device 20 such as a Personal Computer (PC) and the like. In this case, an application 21 and an RIP (Raster Image Processor) 22 are built in the external device 20, wherein the application 21 creates an image data of an image to be formed by the inkjet printer 1, and the RIP (Raster Image Processor) 22 creates a printing data for printing by use of the inkjet printer 1 on the basis of the image data.

(Inkjet Printer 1)

Figure 3:
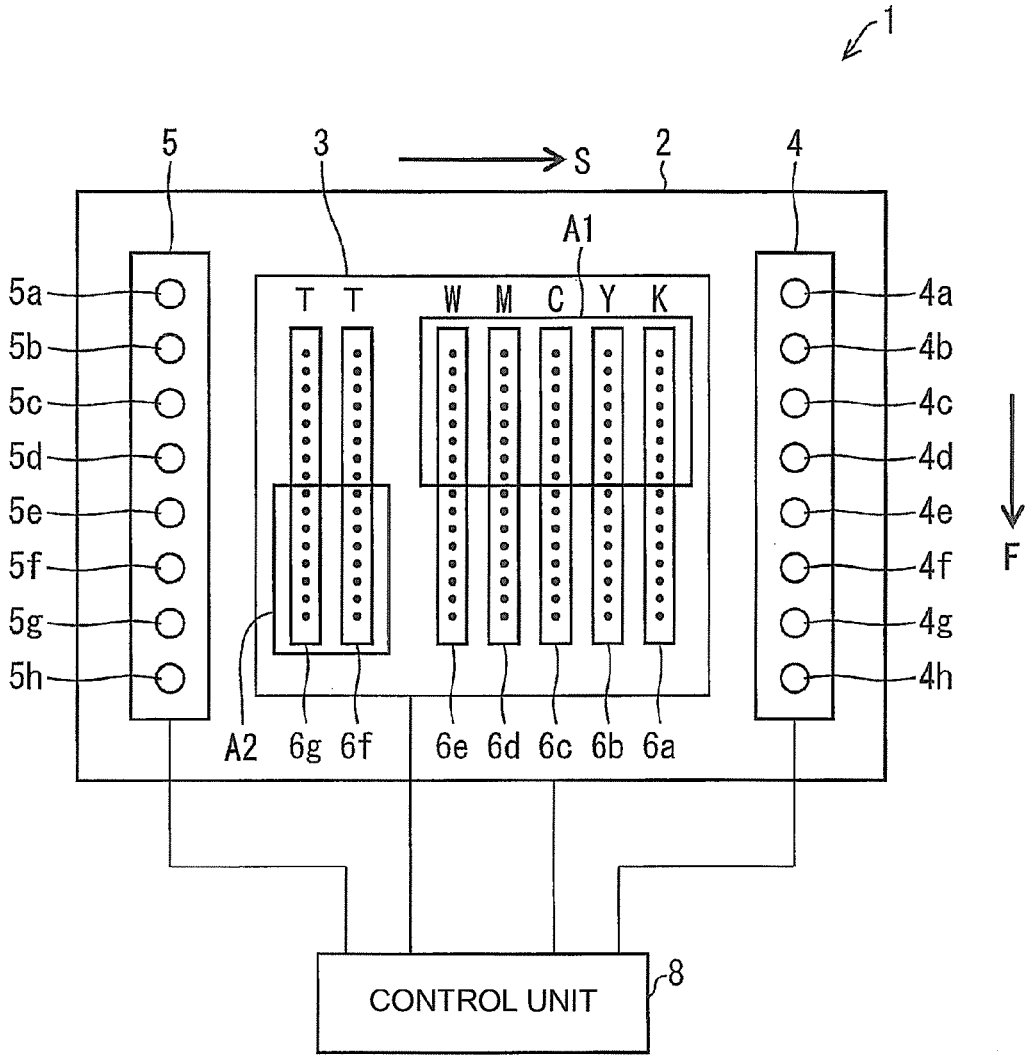
FIG. 3 is a drawing for explaining an outline of an inkjet printer 1 to be used for the image forming method according to the embodiment of the present disclosure.

As shown in FIG. 3, the inkjet printer 1 includes a carriage 2 and a head unit 3, and the head unit 3 is provided with an inkjet head 6 (6*a* through 6*g*), and ultraviolet irradiation devices 4 and 5. Moreover, the inkjet printer 1 also includes a control unit 8 that controls the carriage 2, the inkjet head 6, the ultraviolet irradiation device 4 and the ultraviolet irradiation device 5.

As shown in FIG. 3, the ultraviolet irradiation device 4 includes eight UV-LEDs (ultraviolet light emitting elements) 4*a*, 4*b*, 4*c*, 4*d*, 4*e*, 4*f*, 4*g*, and 4*h* (4*a* through 4*h*); and in the same way, the ultraviolet irradiation device 5 includes eight UV-LEDs 5*a*, 5*b*, 5*c*, 5*d*, 5*e*, 5*f*, 5*g*, and 5*h* (5*a* through 5*h*). Each of the UV-LEDs (4*a* through 4*h*) and the UV-LEDs (5*a* through 5*h*) can independently be set for its lighting intensity.

In the inkjet head 6, there are formed a plurality of nozzles (not illustrated) for discharging ink as droplets. As shown in FIG. 3, the inkjet heads 6*a*, 6*b*, 6*c*, 6*d* and 6*e* discharge color ink of black (K), yellow (Y), cyan (C), magenta (M), and white (W), respectively. Meanwhile, the inkjet heads 6*f* and 6*g* discharge transparent ink (T).

The control unit 8 carries out drive control of the carriage 2, ink discharge control of the inkjet head 6, and ultraviolet irradiation control of the ultraviolet irradiation device 4 as well as the ultraviolet irradiation device 5. According to this configuration, the inkjet printer 1 is able to individually form the first primer layer 31, the second primer layer 32, and the color ink layer 33. Incidentally, the control unit 8 comprises a computer as an essential part, which includes, for example, a CPU, a ROM, and a RAM. Each control of the control unit 8, to be described later, is achieved by loading predetermined computer software into the CPU or the RAM, and operating the computer software under control of the CPU.

In the inkjet printer 1, as being supported by the carriage 2 that can reciprocate in a scanning direction (a direction 'S'), the head unit 3 can move in the direction 'S'. Moreover, while moving in the direction 'S', the head unit 3 is able to discharge ultraviolet curable ink by use of the inkjet head 6, and it is also able to irradiate with ultraviolet light by use of the ultraviolet irradiation devices 4 and 5. Then, the inkjet printer 1 transfers the medium 40 for a distance of pass width in a feed direction (a direction 'F') that is perpendicular to the direction 'S', and moves the head unit 3 in the direction 'S' that is the scanning direction, so as to form an image on the medium 40.

Incidentally, in the image forming method according to the present embodiment, explained is a printing operation in which printing is carried out with two passes, as an example. In other words, the printing operation is explained on the assumption that one transfer distance of the medium is calculated as a result of dividing a line of nozzles of the inkjet head 6 by the number of passes, namely "2" (to result in a distance of pass width), and then two (the number of passes) scanning operations are carried out for the printing operation on the same printing area.

(First Primer Layer Forming Process)

In the first primer layer forming process, a printing data for forming the first primer layer 31 is created in such a way as to have a perforated state by way of thinning out in a printing data.

In this way, according to the printing data for forming the first primer layer 31, the first ink being ultraviolet curable ink is discharged onto the medium 40, in such a way as to be perforated, and then the first ink is fully hardened by irradiation of ultraviolet light. According to this process, the inkjet printer 1 forms the first primer layer 31, which becomes an uneven foundation for obtaining a wrinkle-like texture, on the medium 40 (as (a) shows in FIG. 1).

(Creation of Printing Data)

The printing data for forming the first primer layer 31 is created by use of the application 21 shown in FIG. 2. Incidentally, for dealing with the printing data, a texture function that the application 21 includes should preferably be used.

At first, with an image data of an EPS format, a TIFF format, and the like, gray-scale processing is carried out on the image data, by the application 21, in order to obtain the printing data for forming the first primer layer 31. Thus, a process is conducted in such a way that the printing data for forming the first primer layer 31 is printed by using only the black (K).

Next, in the printing data on which gray-scale processing has already carried out, blurring processing is carried out by the application 21, around a section where a wrinkle-like convex part is to be formed, as required. Thus, image processing can be conducted in such a way as to round off an edge of the section where the convex part is to be formed in the image data. Then, the printing data for forming the first primer layer 31 is so processed as to become able to form a naturally-shaped wrinkle on the medium 40. Moreover, the gray-scale processing is carried out in advance of the blurring processing; and therefore the blurring processing is carried out more uniformly than it is done on a color image. As a result, this configuration is able to save the trouble at the time of the blurring processing.

Next, with respect to an image to be printed on the medium 40, at least one of changing a resolution of the image and reduction/enlargement of the image is carried out for the printing data for forming the first primer layer 31, by the application 21, in response to a wrinkle shape that is needed. Thus, the printing data for printing in a perforated state is completed. Incidentally, "a perforated state" means a condition where a density of droplets of the ultraviolet curable ink discharged on the medium 40 becomes heterogeneous, so that smoothness of the first primer layer 31 formed of the first ink is not uniform on the medium 40.

Next, a thinning-out process is carried out by the RIP 22. The thinning-out process is implemented by way of creating a printing data of a dot format for forming the first primer layer 31, and diminishing a predetermined pixel in the printing data. Incidentally, the predetermined pixel to be thinned out may be identified by using a predetermined mask, or may be identified by using random numbers, a predetermined mathematical formula, and the like.

More specifically to describe, a case of discharging the ultraviolet curable ink for all pixels in a printing data that forms an image having a printing density of 100% is identified as 100% in the thinning-out process. For example, "carrying out a 2% thinning-out process" means discharging the ultraviolet curable ink only for 98% of all pixels in a printing data that forms an image having a printing density of 100%.

In the image forming method according to the present embodiment, the roughness of the first primer layer 31 can be adjusted by the thinning-out process. Thus, a wrinkle-like texture in a print image can be adjusted. The thinning-out process on the printing data for forming the first primer layer 31 should preferably be configured in an appropriate manner, according to a wrinkle-like texture that is needed. Being not limited to any specific rate, the thinning-out process should preferably be within a range of 3% to 85%; and more preferably it should be within a range of 6% to 75%.

The printing data for forming the first primer layer 31 can be created by way of blurring processing, gray-scale processing, changing a resolution, reduction/enlargement of an image, and thinning out. In other words, the image forming method according to the present embodiment can be carried out by using a commonly-used application for image processing. Therefore, it is not necessary to specify any special printing condition for forming the first primer layer 31 in the inkjet printer 1. Moreover, since wrinkle-like printing can be set by the RIP 22, there is an advantage that a user can continuously carry out wrinkle-like printing and printing without wrinkle-like printing. Still further, since each printing setup condition in the printing data is collected in the RIP 22; even if a setup error happens in relation to wrinkle-like printing and printing without wrinkle-like printing, the error can easily be corrected as long as it is before the printing, by way of correcting only the setup condition in the RIP 22 without stopping the inkjet printer 1.

Next, the RIP 22 sends the printing data processed by use of the application 21, as the printing data for forming the first primer layer 31, to the control unit 8. Incidentally, in an image forming method according to another embodiment, the thinning-out process on the printing data may be carried out, not by the RIP 22 but by the application 21.

Then, the RIP 22 sends the printing data for forming the first primer layer 31, to the control unit 8 of the inkjet printer 1.

(Forming the First Primer Layer)

Next, the control unit 8 receives the printing data for forming the first primer layer 31, and discharges the first ink onto the medium 40 by way of controlling the head unit 3 according to the printing data, and then hardens the first ink (as (a) shows in FIG. 1).

While moving in the direction 'S' (outward move) as the scanning direction shown in FIG. 3, the head unit 3 discharges ink of the black (K) as the first ink that is ultraviolet curable ink, out of a first discharging area A1 of the inkjet head 6*a*, in such a way as to make a perforated state. At the same time, the UV-LEDs 5*a* through 5*h* of the ultraviolet irradiation device 5, provided in the head unit 3, irradiate the first ink discharged on the medium 40, with ultraviolet light of an adequate intensity level for fully hardening the ink.

Thus, after landing onto the medium 40 so as to be in a perforated state, the first ink is hardened before it becomes smoothed. Therefore, the first primer layer 31, which becomes an uneven foundation for obtaining a wrinkle-like texture, can properly be formed.

Furthermore, also in a return move in the direction 'S', the head unit 3 discharges the first ink out of the first discharging area A1 of the inkjet head 6*a*, in the same way as it does in the outward move of the head unit 3; and at the same time, the UV-LEDs 4*a* through 4*h* of the ultraviolet irradiation device 4 irradiate the first ink discharged on the medium 40 with ultraviolet light. In this way, the first primer layer 31 can be fully hardened in the same way as it is in the outward move of the head unit 3. Incidentally, the first primer layer 31 is formed by way of multiple scanning operation in which the head unit 3 travels multiple times over the first primer layer 31, and the first primer layer 31 is irradiated with ultraviolet light multiple times.

Moreover, in the first primer layer forming process included in the image forming method according to the present embodiment, the first primer layer forming process is carried out multiple times, in such a way that the first primer layer 31 on the medium 40 becomes overlapping, in accordance with the same printing data that the control unit 8 receives from the RIP 22. Thus, a height of a convex part in the first primer layer 31 can be adjusted. Accordingly, a wrinkle-like texture to be formed in a print image can properly be adjusted. Incidentally, the number of operations of the first primer layer forming process for forming one image should preferably be adjusted in an appropriate manner, according to a wrinkle-like texture that is needed. Being not limited to any specific number, preferably the number of operations for forming the first primer layer should be within a range of three to ten.

(Second Primer Layer Forming Process)

As (b) shows in FIG. 1, in the second primer layer forming process, the second primer layer 32 is formed by way of discharging the second ink onto the medium 40 where the first primer layer 31 is already formed.

In the second primer layer forming process, at first, as a preliminary hardening step, the second ink discharged on the medium 40 is polymerized by irradiation with ultraviolet light, so as to increase the viscosity of the ink to an extent that fluidity of the ink is still maintained. Then, afterward as a fully hardening step, the second primer layer is completely hardened by irradiation with ultraviolet light.

Moreover, in the second primer layer forming process included in the image forming method according to the present embodiment, transparent ink of an ultraviolet curable type is used as the second ink. Meanwhile, in the second primer layer forming process, the transparent ink as the second ink is entirely applied onto a whole part of the printing area on the medium 40; where an image is to be formed, and the first primer layer 31 is already formed.

(Preliminary Hardening Step)

At first, while moving in the direction 'S' (outward move) as the scanning direction shown in FIG. 3, the head unit 3 discharges transparent ink (T) that is ultraviolet curable ink, out of a second discharging area A2 of the inkjet heads 6*f* and 6*g*. At the same time, the UV-LED 5*a* of the ultraviolet irradiation device 5 of the head unit 3 turns on in order to irradiate the second ink, with ultraviolet light of an intensity level for increasing the viscosity of the ink to an extent that fluidity of the second ink is still maintained, without fully hardening the second ink. Thus, the second ink is preliminarily hardened.

In the preliminary hardening step, as shown in FIG. 3, ultraviolet irradiation is carried out from the UV-LED 5*a* of the ultraviolet irradiation device 5 located behind the second discharging area A2 for discharging the second ink, in the outward move in the direction 'S'. Thus, the second ink promptly increases its viscosity. Moreover, in the ultraviolet irradiation device 5, with the ultraviolet irradiation being conducted out of the UV-LED 5*a* located at a position furthest from the second discharging area A2, the intensity of the ultraviolet light, with which the second ink is irradiated, is adjusted. In this way, an intensity adjustment of the ultraviolet light in the preliminary hardening step can be made by adjusting the number of lighted UV-LEDs, an output of ultraviolet light emitted from each UV-LED, a distance between an UV-LED and the second ink discharged on the medium 40, and the like.

When a minimum value of an intensity of ultraviolet light that can fully harden the ultraviolet curable ink as the second ink is referred to as 100%, it is preferable in the preliminary hardening step for the second primer layer 32 that the second ink discharged on the medium 40 is irradiated with ultraviolet light of an intensity within a range of 0.03% to 2.5%. If the intensity of the ultraviolet light, with which the second ink is irradiated, is within a range of 0.03% to 2.5% of the minimum value of an intensity that can fully harden the second ink, the second ink can preliminarily be hardened to an extent that fluidity of the ink is still maintained. Thus, the fine unevenness formed by the first primer layer 31 can be canceled with the second ink. Moreover, increasing the viscosity of the second ink prevents the second ink from flowing out of the printing area on the medium 40. Incidentally, intensity of each UV-LED is specified by the RIP 22. Moreover, the minimum value of an intensity of ultraviolet light that can fully harden the ultraviolet curable ink should preferably be adjusted in an appropriate manner, depending on the type of the ultraviolet curable ink, a film thickness of the second primer layer, and the like.

Furthermore, since the second ink is transparent ink of an ultraviolet curable type; and then, being compared with color ink containing pigment, the second ink is able to prevent the ultraviolet irradiation from being blocked. Therefore, the viscosity of the transparent ink (T) can properly be increased by way of irradiating the ink with ultraviolet light, and the fluidity of the transparent ink (T) can more properly be controlled.

Furthermore, also in the return move in the direction 'S' that is a scanning direction, the head unit 3 discharges the transparent ink (T) that is a ultraviolet curable ink, by way of activating the inkjet head 6*f* and 6*g*. Meanwhile, in the return move, the second ink discharged onto the medium 40 is irradiated with ultraviolet light emitted from the UV-LED 4*a* of the ultraviolet irradiation device 4, the ultraviolet light having the same intensity as in the outward move. Therefore, in the second primer layer forming process, the fluidity of the second ink discharged onto the medium 40 is controlled also in the return move, in the same way as it is in the outward move. Incidentally, the preliminary hardening step is carried out by way of multiple scanning operation in which the head unit 3 travels multiple times over the second primer layer 32, and the second primer layer 32 is irradiated with ultraviolet light multiple times. In this way, in the second primer layer forming process; while the second ink being discharged, the ink is irradiated with the ultraviolet light of an intensity level to an extent that the fluidity of the second ink is still maintained; and therefore the preliminary hardening step for the second ink discharged onto the medium 40 can quickly be carried out. Accordingly, conditions of the unevenness formed by the second primer layer 32 can suitably be controlled.

(Full-Scale Hardening Step)

In a full-scale hardening step for the second primer layer 32, the whole part of the printing area on the medium 40 after the preliminary hardening step is irradiated with ultraviolet light. Incidentally, in the full-scale hardening step, the second ink is not discharged by the head unit 3. Thus, the unevenness formed of the second primer layer 32 can be fixed.

In the full-scale hardening step, ultraviolet light is emitted from the UV-LEDs 5*a* through 5*h* that the ultraviolet irradiation device 5 is provided with. In this step, what is required for the UV-LEDs 5*a* through 5*h* is to irradiate the second ink preliminarily hardened, with ultraviolet light of an intensity that can fully harden the second ink. Being not limited to any specific intensity level, the intensity of the ultraviolet light to be emitted in the full-scale hardening step should preferably be adjusted in an appropriate manner. When an minimum value of an intensity of ultraviolet light that can fully harden the ultraviolet curable ink as the second ink is referred to as 100%, it is preferable to irradiate the second ink discharged on the medium 40 with ultraviolet light of an intensity within a range of 100% to 175%. If the intensity of the ultraviolet light, with which the second ink is irradiated in the full-scale hardening step, is within a range of 100% to 175% of the minimum value of an intensity that can fully harden the second ink, the second primer layer 32 can fully be hardened, and the unevenness formed of the second primer layer 32 can more suitably be fixed.

Incidentally, in the full-scale hardening step, the intensity of the ultraviolet light, with which the second ink is irradiated, can appropriately be adjusted with the number of UV-LEDs for emitting ultraviolet light, an output of ultraviolet light emitted from each UV-LED, a distance between an UV-LED and the second ink discharged on the medium 40, and the like. For example, even in the case where the intensity of ultraviolet light emitted from a UV-LED is only 80% of the intensity with which the second ink can be fully hardened, what is required is to obtain the intensity of ultraviolet light for fully hardening the second ink by providing a plurality of UV-LEDs having that intensity.

Furthermore, also in the return move in the direction 'S', the head unit 3 irradiates the second ink, discharged on the medium 40, with ultraviolet light by using the UV-LEDs 4*a* through 4*h* of the ultraviolet irradiation device 4. In this way, the second primer layer 32 can suitably be hardened, in the same way as it is in the outward move of the head unit 3. Incidentally, the full-scale hardening step is carried out by way of multiple scanning operation in which the head unit 3 travels multiple times over the second primer layer 32, and the second primer layer 32 is irradiated with ultraviolet light multiple times.

(Color Ink Layer Forming Process)

As (c) shows in FIG. 1, in the color ink layer forming process, the color ink layer 33 is formed by way of discharging color ink onto the second primer layer 32.

Incidentally, in the color ink layer forming process included in the image forming method according to the present embodiment, ink of an ultraviolet curable type is used as the color ink.

At first, while moving in the direction 'S' (outward move) as the scanning direction shown in FIG. 3, the head unit 3 discharges the color ink of (Y), (M), (C), (K), and (W) of an ultraviolet curable type, out of the first discharging area A1 of the inkjet head 6 (namely, the inkjet heads 6*a* through 6*e*), according to the image data that has been used for creating the printing data for forming the first primer layer 31. At the same time, the UV-LEDs 5*a* through 5*h* of the ultraviolet irradiation device 5, installed in the head unit 3, irradiate the color ink discharged on the medium 40 with ultraviolet light of an intensity level to an extent that the color ink is fully hardened. In this way, the color ink can suitably be hardened.

Furthermore, also in the return move in the direction 'S', the head unit 3 activates the inkjet head 6*a* (or the inkjet head 6*e*) to discharge the color ink, and moreover radiates the color ink discharged on the medium 40 with ultraviolet light by using the UV-LEDs 4*a* through 4*h* of the ultraviolet irradiation device 4. In this way, the color ink layer 33 can suitably be hardened, in the same way as it is in the outward move of the head unit 3. Incidentally, with respect to forming the color ink layer as well, a hardening step is carried out by way of multiple scanning in the same way as it is done for the first primer layer 31 and the second primer layer 32.

In the image forming method according to the present embodiment, the unevenness for obtaining a wrinkle-like texture can be smoothed by way of forming the first primer layer 31 and the second primer layer 32. Therefore, the color ink layer 33 can suitably spread on the second primer layer 32 so that it is possible to represent a color gamut equivalent to a full-color print of a plane image, by the color ink layer 33. Furthermore, since ultraviolet curable ink is used as the color ink, it is possible to form a high-quality color image that is provided with a wrinkle-like texture, and able to recreate wide color space.

(Image Forming Method According to Another Embodiment)

The image forming method according to the present disclosure is not limited to the embodiment described above. For example, in an image forming method according to another embodiment, the second ink and the color ink for forming the color ink layer may be either of solvent UV ink and color ink. Solvent UV ink is an ultraviolet curable ink which contains solvent.

For example, in the case where solvent UV ink is used as the second ink, in the second primer layer forming process, viscosity of the second ink is controlled by way of heating the solvent UV ink discharged on the medium 40, with a heating unit, such as a heater provided at a platen. Afterwards, the second primer layer formed of the solvent UV ink is fully hardened by way of ultraviolet irradiation. Moreover, also in the color ink layer forming process, the color ink layer is hardened in the same manner, by way of heating the color ink layer with a heating unit, and by ultraviolet irradiation.

Also, in the case where the second primer layer and the color ink layer are formed by using solvent ink, a viscosity control and a drying step for the second primer layer and the color ink layer should preferably be carried out by way of heating with a heating unit.

According to the configuration described above as well, viscosity of either of solvent UV ink and solvent ink can be increased by way of solvent volatilization through heating, so that conditions of the unevenness for obtaining a wrinkle-like texture can suitably be controlled. Thus, a color gamut equivalent to a full-color print can be represented by the color ink layer.

Moreover, in the image forming method according to the present disclosure, the second ink to be used in the second primer layer forming process is not limited to transparent ink (T). Then, in a second primer layer forming process included in an image forming method according to another embodiment, for example, white ink (W) is used as the second ink. When white ink (W) is used for forming the second primer layer 32, it is possible to suitably prevent a color of the second primer layer 32 from affecting the color ink layer 33 to be formed on the second primer layer 32.

Incidentally, in an image forming method according to still another embodiment, it is also possible to use any color ink out of (Y), (M), (C), and (K) other than transparent ink (T) and white ink (W), the color ink being as the second ink for forming the second primer layer 32. According to even this configuration, the fine unevenness of the first primer layer 31 can be canceled, and therefore the second primer layer can suitably be formed.

Moreover, in the image forming method according to the present disclosure, the first ink to be used in the first primer layer forming process is not limited to black ink (K). Then, in an image forming method according to another embodiment, for example, one of white ink (W), transparent ink (T), as well as color ink such as yellow (Y), magenta (M), and cyan (C) can be used as the first ink. According to even this configuration, the first primer layer can suitably be formed. Incidentally, in the case where any ink, for example, color ink, other than transparent ink (T) and white ink (W) is used as the first ink, it is more preferable to use white ink (W) as the second ink, in order to form the second primer layer 32. A use of white ink (W) as the second ink can prevent a color of the color ink of the first primer layer 31 from affecting a color of the color ink layer 33 so that the color ink layer 33 can represent a desired color.

Incidentally, in the case where white ink (W) is used as the second ink, it should be preferable to discharge the white ink (W) onto the medium 40 under a condition that a printing density of the white ink (W) becomes 150%, to preliminarily harden the white ink (W) by way of ultraviolet irradiation, and afterward to carry out a full-scale hardening step, for forming the second primer layer. Thus, the second primer layer can suitably be formed.

Furthermore, in an image forming method according to still another embodiment, printing by use of the second ink in a second primer layer forming process is carried out in accordance with a printing data as a result of a thinning-out process.

In other words, a first primer layer and a second primer layer may be formed in such a way that part of a convex portion of the first primer layer protrudes from a surface of the second primer layer, by way of discharging the second ink according to a result of the thinning-out process. Moreover, the first primer layer and the second primer layer may be formed in such a way that, while the first primer layer being covered with the second primer layer, part of a surface of the medium 40 is exposed, by way of discharging the second ink according to a result of the thinning-out process.

In an image forming method according to an embodiment of the present disclosure, a configuration of the first primer layer and the second primer layer is not limited to anything, as far as unevenness formed with the first primer layer and the second primer layer can be smoothed by way of canceling fine unevenness of the first primer layer with the second primer layer. If the unevenness of the first primer layer can be smoothed with the second primer layer, color ink can suitably spread on the first primer layer and the second primer layer. Accordingly, a color gamut of a color ink layer can suitably be represented.

Furthermore, in an image forming method according to still another embodiment, a transparent ink layer may be formed on a color ink layer. In this case, in a color ink layer forming process, color ink should preferably be discharged only from the first discharging area A1 of the inkjet heads 6*a* through 6*e* shown in FIG. 3; the first discharging area A1 being located at a rear side in the feed direction (direction 'F') for feeding the medium 40; meanwhile, transparent ink should be discharged only from nozzle lines of the second discharging area A2 of the inkjet heads 6*f* and 6*g*; the second discharging area A2 being located at a front half in the direction 'F'. Thus, onto the medium 40 being transferred in the direction 'F', at first the color ink can be discharged from the first discharging area A1; and subsequently the transparent ink can be discharged onto the color ink layer formed on the medium 40 that has been transferred in the direction 'F', from the second discharging area A2.

Figure 4:
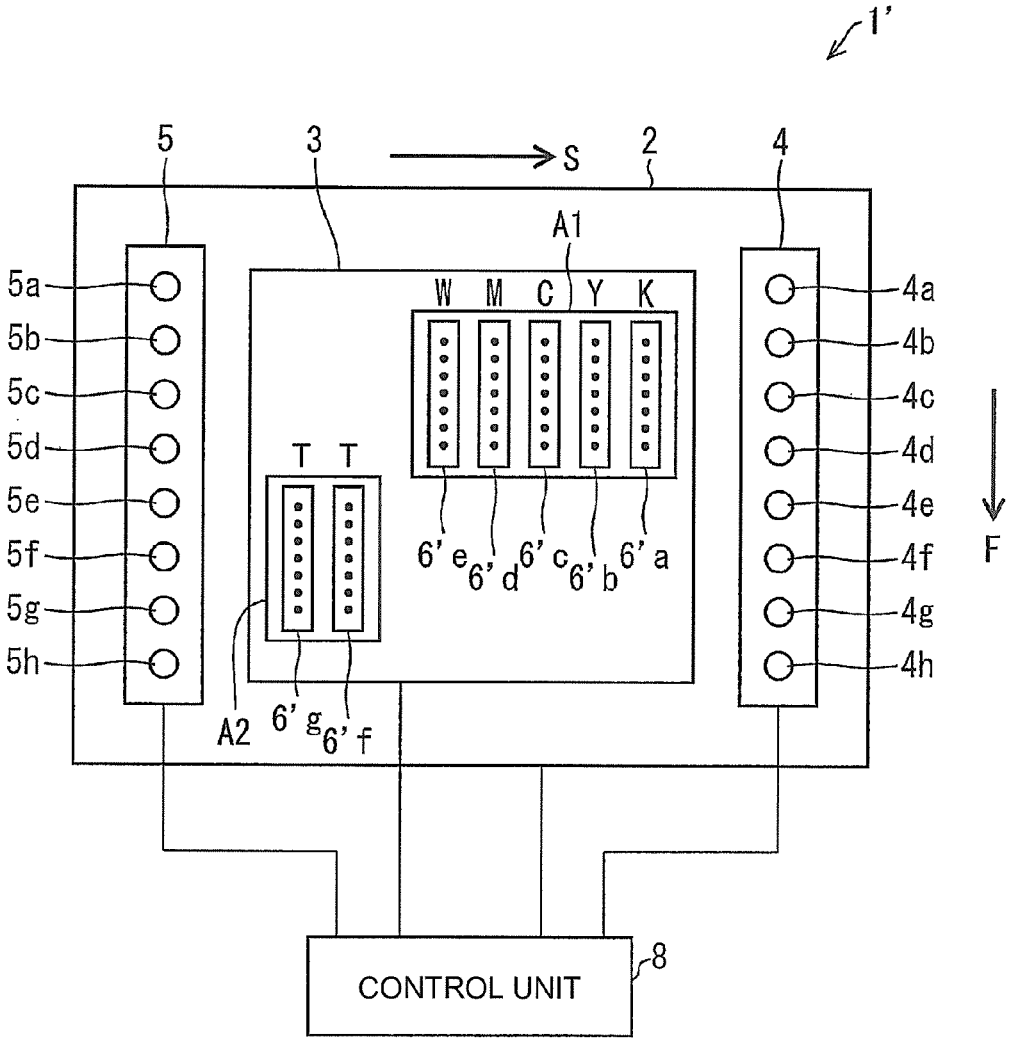
FIG. 4 is a drawing for explaining an outline of an inkjet printer 1' to be used for the image forming method according to the embodiment of the present disclosure.

Moreover, in the image forming method according to the present disclosure, an inkjet printer to be used for carrying out the first primer layer forming process, the second primer layer forming process, and the color ink layer forming process is not limited to the inkjet printer 1 shown in FIG. 1. For example, in an image forming method according to still another embodiment, the first primer layer forming process, the second primer layer forming process, and the color ink layer forming process are carried out by using an inkjet printer 1' shown in FIG. 4. In the image forming method according to the present embodiment, color ink of (W), (Y), (M), (C), and (K) is discharged from inkjet heads 6'*a* through 6'*e* provided inside the first discharging area A1 shown in FIG. 4; and meanwhile, transparent ink (T) is discharged from inkjet heads 6'*f* and 6'*g* provided inside the second discharging area A2. According to this configuration, the first primer layer 31, the second primer layer 32, and the color ink layer 33 can suitably be formed.

Figure 5:
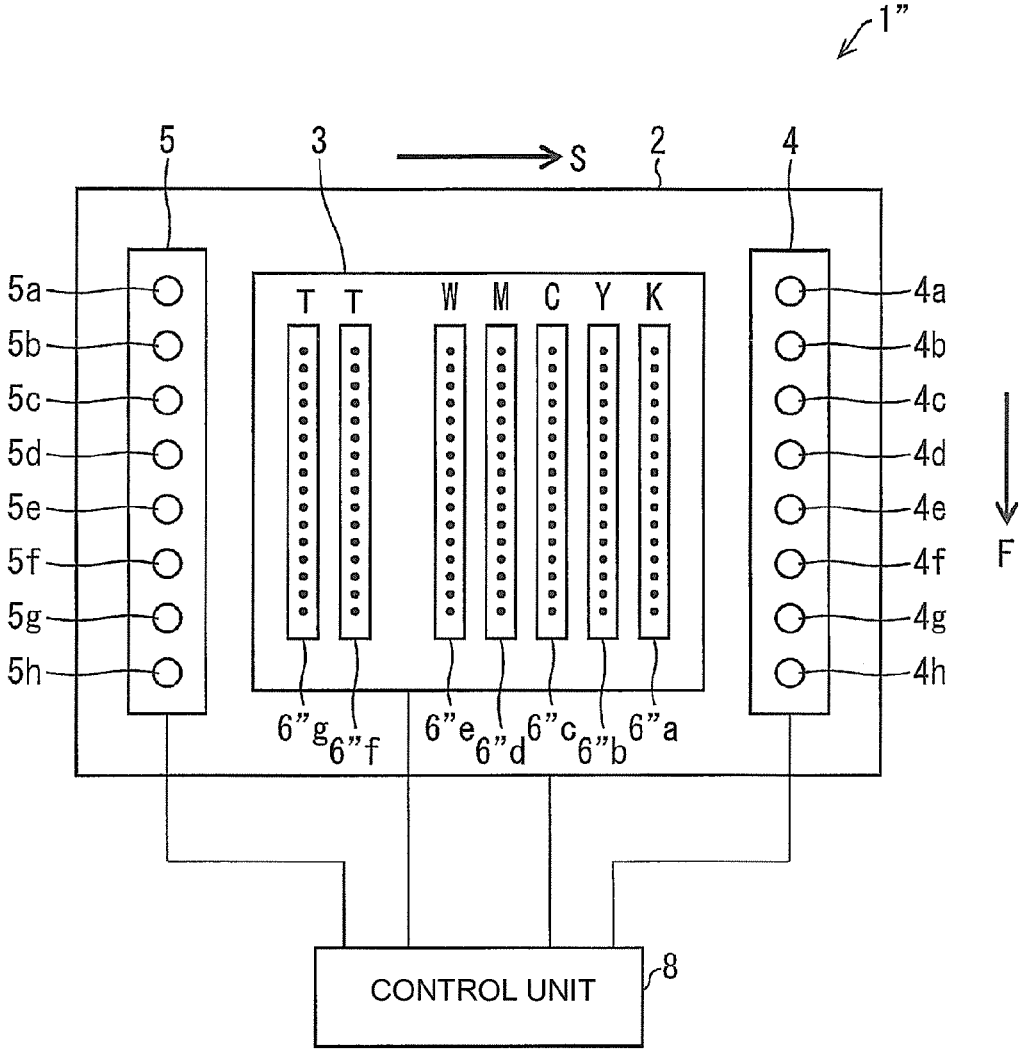
FIG. 5 is a drawing for explaining an outline of an inkjet printer 1" to be used for the image forming method according to the embodiment of the present disclosure.

Furthermore, in an image forming method according to still another embodiment, the first primer layer forming process, the second primer layer forming process, and the color ink layer forming process are carried out by using an inkjet printer 1" that is neither provided with the first discharging area A1 nor the second discharging area A2, as shown in FIG. 5. In the image forming method according to the present embodiment, color ink of (W), (Y), (M), (C), and (K) is discharged from inkjet heads 6"*a* through 6"*e* shown in FIG. 5; and meanwhile, transparent ink (T) is discharged from inkjet heads 6"*f* and 6"*g*. According to this configuration, the first primer layer 31, the second primer layer 32, and the color ink layer 33 can suitably be formed.

The image forming method according to the present disclosure is not limited to any certain configuration of an inkjet head, and the method can be implemented by using various inkjet printers.

(Appendant Descriptions)

An image forming method according to an aspect of the present disclosure includes: a first primer layer forming process to form a first primer layer 31 by way of discharging first ink, which is photo-curable ink, onto a medium (a recording medium) 40 in such a way as to make a perforated coat, and hardening the first ink by light irradiation; a second primer layer forming process to form a second primer layer 32 by way of discharging second ink onto the medium 40 on which the first primer layer 31 is already formed; and a color ink layer forming process to form a color ink layer 33 by way of discharging color ink onto the second primer layer.

According to the configuration described above, the first primer layer 31 is formed on the medium 40 in advance, so as to become an uneven foundation for obtaining a wrinkle-like texture, by way of discharging the ultraviolet curable ink onto the medium 40 in such a way as to make a perforated coat, and by ultraviolet irradiation. Then, by way of discharging the second ink onto the medium 40 on which the first primer layer 31 is already formed; while coarse unevenness of the first primer layer 31 is maintained, fine unevenness on a surface of the first primer layer 31 can be canceled by the second primer layer 32. Accordingly, it is possible to prevent the fine unevenness on the surface of the first primer layer 31 from blocking a spreading movement of the color ink on the medium 40 at the time when the color ink is discharged. Thus, it is possible to form a high-quality color image on the first primer layer 31 and the second primer layer 32; the high-quality color image being able to represent color space equivalent to a full-color print of a plane image, by use of the color ink layer.

In an image forming method according to an aspect of the present disclosure, it is more preferable to carry out the first primer layer forming process multiple times before the second primer layer forming process.

According to the configuration described above, a height of a convex part in the first primer layer 31 can be adjusted. Accordingly, a wrinkle-like texture can properly be adjusted.

In an image forming method according to an aspect of the present disclosure, it is more preferable that; the second ink is photo-curable ink; and in the second primer layer forming process, after the second ink is discharged, viscosity of the second ink is increased by light irradiation so that the second ink is preliminarily hardened; and then the second ink preliminarily hardened is fully hardened by further light irradiation.

According to the configuration described above, the second ink is preliminarily hardened by way of increasing its viscosity, so that it is possible to suitably prevent an excessive amount of the second ink from flowing out of the medium 40. Furthermore, by way of fully hardening the second ink that is already preliminarily hardened, conditions of the unevenness formed by the first primer layer 31 and the second primer layer 32 can more suitably be controlled.

In an image forming method according to an aspect of the present disclosure, it is more preferable that the second ink is transparent ink.

According to the configuration described above, by way of irradiating transparent ink that does not contain any pigment and the like, with ultraviolet light in the second primer layer forming process, viscosity of the transparent ink can more suitably be increased. Thus, unevenness of the second primer layer can more suitably be controlled. Therefore, it is possible to further suitably form a second primer layer that can prevent a color representation range of the color ink layer, from getting degraded. Thus, the unevenness of the second primer layer 32 can further suitably be controlled. Accordingly, it is possible to further suitably form the second primer layer 32 that can prevent a color representation range of the color ink layer 33, from getting degraded.

In an image forming method according to an embodiment of the present disclosure, it is more preferable that the color ink is photo-curable ink, and the discharged color ink is irradiated with light in the color ink layer forming process.

According to the configuration described above, a color image can be formed, being provided with a wrinkle-like texture and having wide color space.

The present disclosure is not limited to each of the embodiments described above, and various alterations can be made within scopes described in the claims, and an embodiment to be obtained as a result of arbitrarily combining technical means disclosed individually in the different embodiments is also included in a technical scope of the present disclosure.

INDUSTRIAL APPLICABILITY

The present disclosure can be utilized for an inkjet printing method for forming an image provided with a wrinkle-like texture.

What is claimed is:

1. An image forming method, comprising: a first primer layer forming process to form a first primer layer by way of discharging a first ink, which is a photo-curable ink, onto a recording medium in such a way as to make a perforated coat, and hardening the first ink by light irradiation;

a second primer layer forming process to form a second primer layer by way of discharging a second ink onto the recording medium on which the first primer layer is already formed; and a color ink layer forming process to form a color ink layer by way of discharging a color ink onto the second primer layer, wherein the perforated coat is formed in a perforated state, which is a condition where a density of droplets of the first ink discharged on the recording medium becomes heterogeneous, so that smoothness of the first primer layer is not uniform on the recording medium, and wherein a height of each convex portion in the first primer layer is not uniform.

2. The image forming method according to claim 1, wherein the first primer layer forming process is carried out multiple times before the second primer layer forming process.

3. The image forming method according to claim 1, wherein the second ink is a photo-curable ink, and in the second primer layer forming process, after the second ink is discharged, viscosity of the second ink is increased by light irradiation so that the second ink is preliminarily hardened; and then the second ink preliminarily hardened is fully hardened by further light irradiation.

4. The image forming method according to claim 1, wherein the color ink is a photo-curable ink, and the discharged color ink is irradiated with light in the color ink layer forming process.

5. The image forming method according to claim 1, further comprising:

a height adjusting process to adjust a height of a convex part in the first primer layer.

6. The image forming method according to claim 2, wherein the second ink is a photo-curable ink, and in the second primer layer forming process, after the second ink is discharged, viscosity of the second ink is increased by light irradiation so that the second ink is preliminarily hardened; and then the second ink preliminarily hardened is fully hardened by further light irradiation.

7. The image forming method according to claim 3, wherein the second ink is a transparent ink.

8. The image forming method according to claim 6, wherein the second ink is a transparent ink.

* * * * *